US005484678A

United States Patent [19]

Pickering et al.

[11] Patent Number: 5,484,678

[45] Date of Patent: Jan. 16, 1996

[54] TONER COMPOSITIONS WITH CHARGE ADDITIVE MIXTURE

[75] Inventors: Thomas R. Pickering, Webster; Denise R. Bayley, Fairport; Roger N. Ciccarelli, Rochester, all of N.Y.

[73] Assignee: Xerox Corporation, Stamford, Conn.

[21] Appl. No.: 347,670

[22] Filed: Dec. 1, 1994

[51] Int. Cl.[6] ..... G03G 9/097

[52] U.S. Cl. ..... 430/110; 430/106.6

[58] Field of Search ..... 430/106, 106.6, 430/110

[56] References Cited

U.S. PATENT DOCUMENTS

| | | | |
|---|---|---|---|
| 4,411,974 | 10/1983 | Lu et al. | 430/106 |
| 4,656,112 | 4/1987 | Kawagishi et al. | 430/110 |
| 4,845,003 | 7/1989 | Kiriu et al. | 430/110 |
| 5,250,380 | 10/1993 | Bayley et al. | 430/106.6 |
| 5,250,381 | 10/1993 | Ciccarelli et al. | 430/106.6 |
| 5,256,515 | 10/1993 | Law et al. | 430/106.6 |
| 5,302,481 | 4/1994 | Ong | 430/106.6 |

*Primary Examiner*—John Goodrow
*Attorney, Agent, or Firm*—E. O. Palazzo

[57] ABSTRACT

A toner composition comprised of resin, pigment and a charge additive mixture of components of the formulas wherein $R_1$ is an alkoxy group, $R_2$ is an alkyl group, and n is an integer of 1 to 3.

33 Claims, 5 Drawing Sheets

TONER COMPOSITIONS WITH CHARGE ADDITIVE MIXTURE

BACKGROUND OF THE INVENTION

The present invention relates to toner and developer compositions, and more specifically, to negatively charged toner compositions comprised of certain charge enhancing additives. The toners and developers of the present invention can be selected for a number of electrophotographic imaging and printing processes including known xerographic processes. Also, the toners and developers of the present invention can be utilized for color, inclusive of trilevel color xerography, reference U.S. Pat. Nos. 4,948,686; 5,212,036; 5,208,129, and full process color, reference U.S. Pat. No. 5,275,905, the disclosures of which are totally incorporated herein by reference. In embodiments, there are provided in accordance with the present invention toner compositions comprised of a polymer or polymer resins, pigment particles or dye molecules, and aluminum salt mixtures of charge enhancing additives obtained, for example, by the reaction of an inorganic aluminum salt, such as aluminum halide like chloride or aluminum sulfate, with a mixture of alkylsalicylic acid and an alkoxy benzoic acid. In embodiments, the present invention is directed to toners with mixtures of aluminum salts of di-tertiary-alkyl, especially butylsalicylic acid and nonyloxybenzoic acid charge enhancing additives. Toners with the forementioned charge additives in embodiments of the present invention enable the provision of developers with substantially stable negative triboelectical toner characteristics which permit the generation of high quality images subsequent to development, that is images with substantially no background deposits and substantially no smearing for a broad range of relative humidity conditions, that is for example from between about 20 to 90 percent relative humidity at an effective range of, for example, temperature zones ranging, for example, from between about 20° C. to about 80° C. Also, the toners of the present invention possess a strongly negative charge, and wherein in embodiments the charge additive mixture may also function as a lubricant. Other advantages of the present invention include enabling negatively charged toners containing positive charging pigments and overcoming or minimizing the charging generated by surface additives.

Toners with certain aluminum charge enhancing additives are known, reference U.S. Pat. No. 4,845,003, the disclosure of which is totally incorporated herein by reference. The charge additives of the aforementioned patent comprise an aluminum compound of a hydroxycarboxylic acid which may be substituted with alkyl and/or aralkyl, reference the Abstract for example. Infrared analysis of a number of the aluminum charge enhancing additives of the '003 patent indicates the presence of free 3,5-di-t-butylsalicylic acid in significant amounts. The toner/developer performance properties and characteristics of the present invention are superior in some respects as compared, for example, to the toners of the '003 patent. For example, toners with the charge enhancing additive mixture of the present invention possess substantially lower CWS and CLC than toners of the '003 patent; CWS=Corrected Wrong Sign toner and CLC=Corrected Low Charge as determined by Charge Spectra analyses. The aforementioned lower characteristics with the toners of the present invention in embodiments enable, for example, developed images of excellent color, excellent image resolution with substantially no background deposits, and substantially stable triboelectric characteristics.

Toners with charge enhancing additives including additives that assist in providing a negative charge to the toner, such as orthohalocarboxylic acids, certain metal complexes and the like, are known. Also known are positively charged toners, reference for example U.S. Pat. Nos. 4,298,672; 4,338,390 and 4,560,635, the disclosures of which are totally incorporated herein by reference.

The following U.S. Pat. Nos. are also mentioned: 4,656,112, which discloses, for example, toners with a zinc complex compound of an aromatic hydroxycarboxylic acid with or without a substituent as a charge agent, see the Abstract, and column 2; and as background interest 4,411,974.

Processes for obtaining electrophotographic, including xerographic, and two-colored images are known. In U.S. Pat. No. 4,264,185, the disclosure of which is totally incorporated herein by reference, there is illustrated an apparatus for forming two-color images by forming a bipolar electrostatic image of a two-color original document on a photoconductive drum. A first developing unit applies a toner of a first color and polarity to the drum and a second developing unit applies a toner of a second color and polarity to the drum to form a two-color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner.

In U.S. Pat. No. 4,308,821, there is disclosed a method and apparatus for forming two-color images which employs two magnetic brushes. The first developed image is not disturbed during development of the second image since the second magnetic brush contacts the surface of the imaging member more lightly than the first magnetic brush, and the toner scraping force of the second magnetic brush is reduced in comparison with that of the first magnetic brush by setting the magnetic flux density on a second nonmagnetic sleeve with an internally disposed magnet smaller than the magnetic flux density on a first magnetic sleeve, or by adjusting the distance between the second nonmagnetic sleeve and the surface of the imaging member. In addition, the toners selected may have different quantities of electric charge.

Further, U.S. Pat. No. 4,378,415, the disclosure of which is totally incorporated herein by reference, illustrates a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles. In U.S. Pat. No. 4,430,402, there is illustrated a two-component type dry developer for use in dichromatic electrophotography which comprises two kinds of developers, each of which are comprised of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

Furthermore, in U.S. Pat. No. 4,525,447, the disclosure of which is totally incorporated herein by reference, there is illustrated an image forming method which comprises forming on a photosensitive member an electrostatic latent image having at least three different levels of potentials, or comprising first and second latent images and developing the first and second latent images with a three component developer.

Toners with certain zinc or aluminum salicylate complex charge enhancing additive in admixture with a second nonmetal containing charge enhancing additive are illustrated in copending application U.S. Ser. No. 755,979, the disclosure of which is totally incorporated herein by reference. The toner compositions of the aforementioned patent application contain, for example, a blend of two known CCA's, one positive and the other negative. With the present invention, the synthesized mixture contains a complete novel charge director mixture of a zinc 3,5-di-tert-butyl salicylate compound and an alkyl pyridinium halide compound as the charge control additive mixture, a resin, a colorant, a colloidal silica external additive, and a metal salt of a fatty acid external additive.

In U.S. Pat. No. 5,250,381, the disclosure of which is totally incorporated herein by reference, there is illustrated a negatively charged toenr composition comprised of resin particles, pigment particles, and an aluminum charge enhancing additive obtained from the reaction of an aluminum inorganic salt solution, and coumarin-3-carboxylic acid In copending application U.S. Ser. No. 973,509, the disclosure of which is totally incorporated herein by reference, there is illustrated a toner composition comprised of resin, pigment and a charge enhancing additive of the formulas

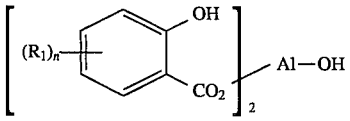

or

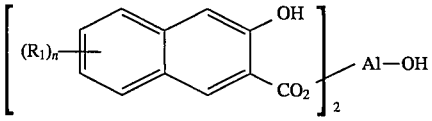

wherein $R_1$ is selected from the group consisting of hydrogen and alkyl, and n is zero, 1, 2, 3 or 4.

DESCRIPTION OF THE FIGURES

FIGS. 1 to 4 are IR spectras as follows:

FIG. 1 is a full IR spectra of Examples IV A, B, C and D.

FIG. 2B is "tilted" different than FIG. 2A to afford a better view of particular peaks.

FIG. 3 is the same as FIG. 2B, but viewed at the same angle as FIG. 2A.

FIG. 4 illustrates the individual spectra of 3) hydroxy bis[3,5-di-tertiary-butyl salicylic] aluminate, 2) hydroxy bis [4-nonyloxbenzoic] aluminate which are 2 of the 3 components in many of the mixtures of the present invention in embodiments, and 1) hydroxy bis[3,5-di-tertiary-butyl salicylic] aluminate, hydroxy bis[4-nonyloxbenzoic] aluminate, and hydroxy[3,5-di-tertiary-butyl salicylic, 4-nonyloxbenzoic] aluminate. This indicates that 1 is more than the sum of 2 and 3.

SUMMARY OF THE INVENTION

Figure 1:
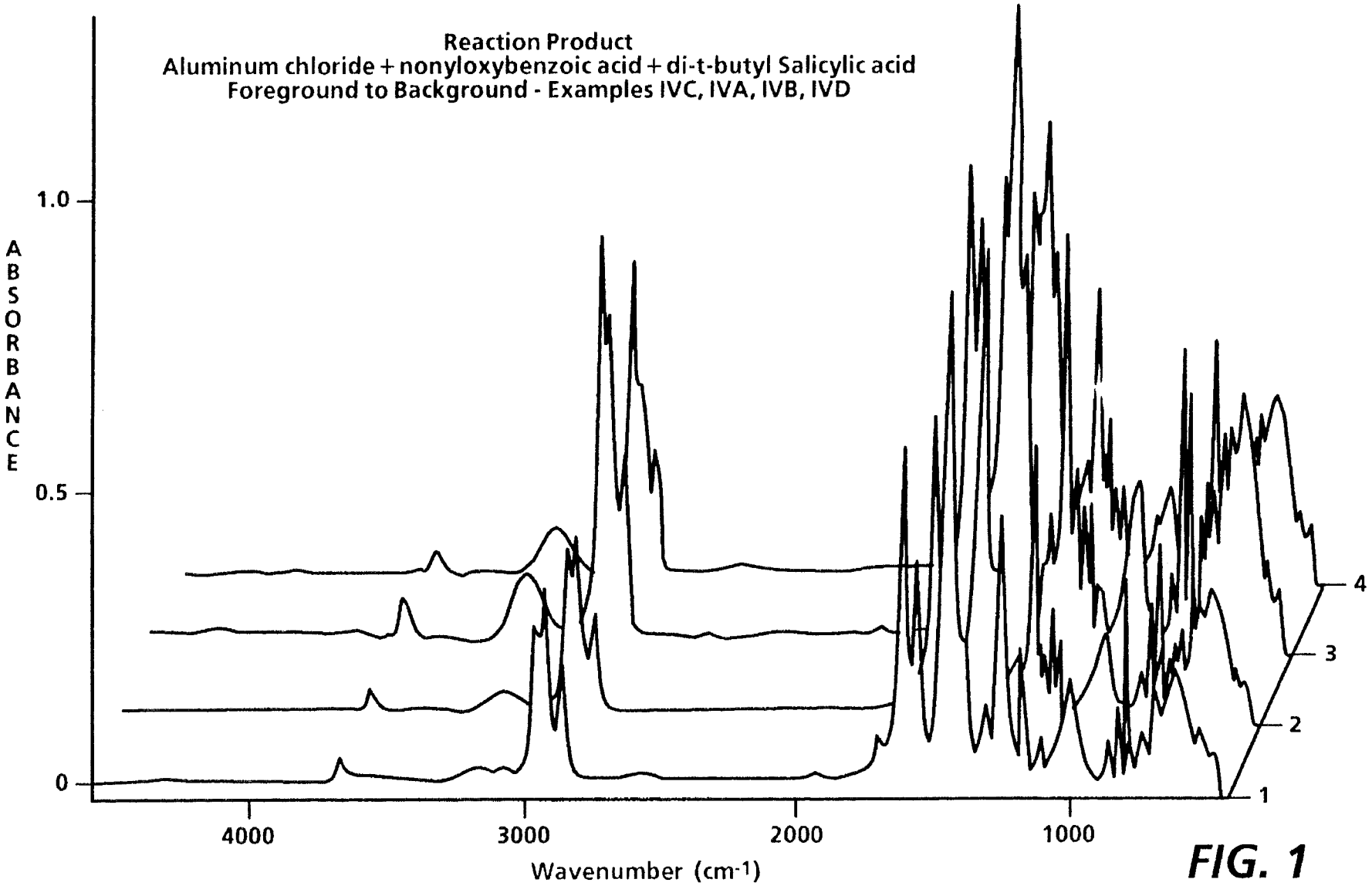
Figure 2A:
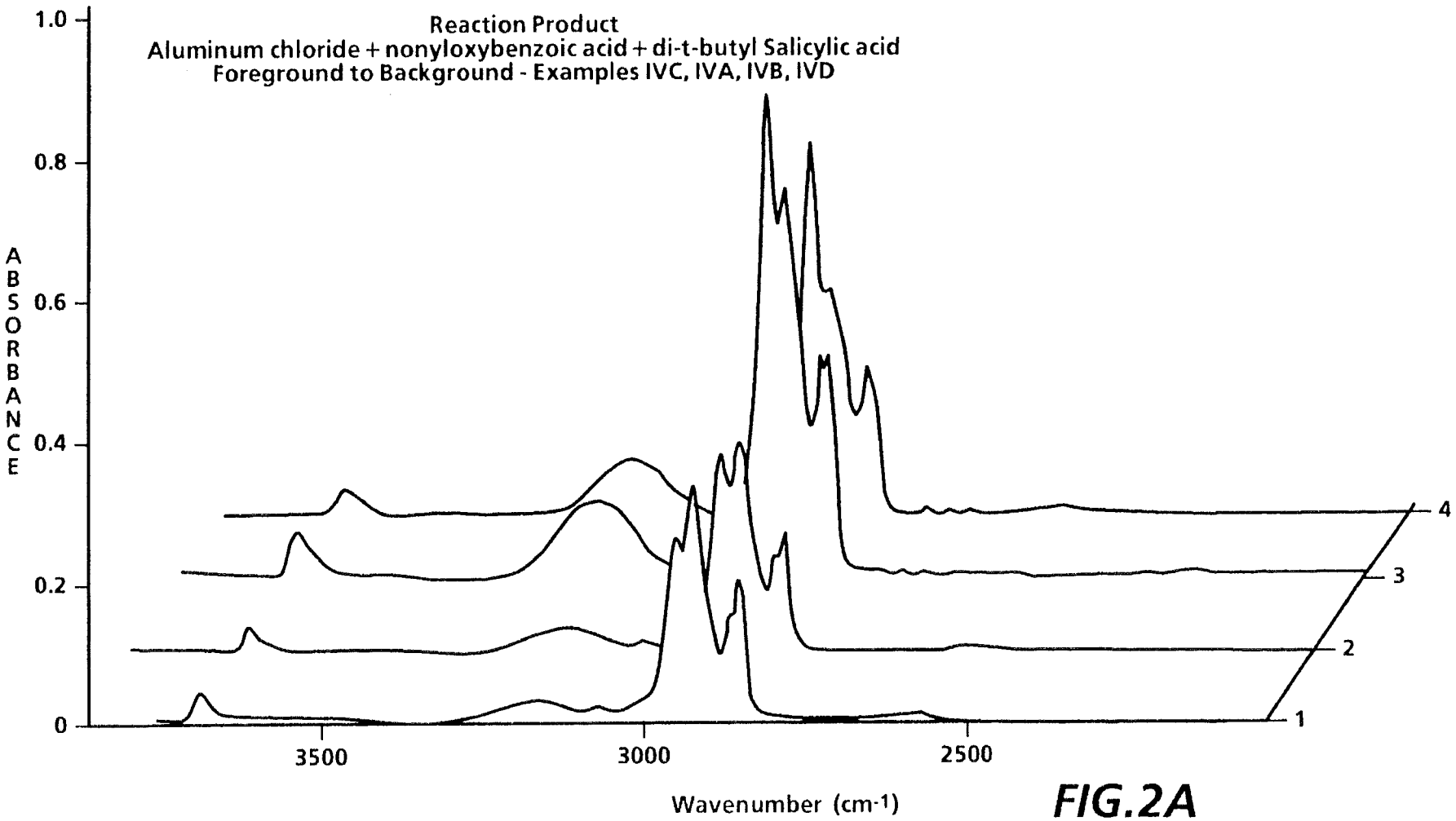
FIGS. 2A and 2B are the same set of spectra as FIG. 1, but expanded to two pages for easier examination.
Figure 2B:
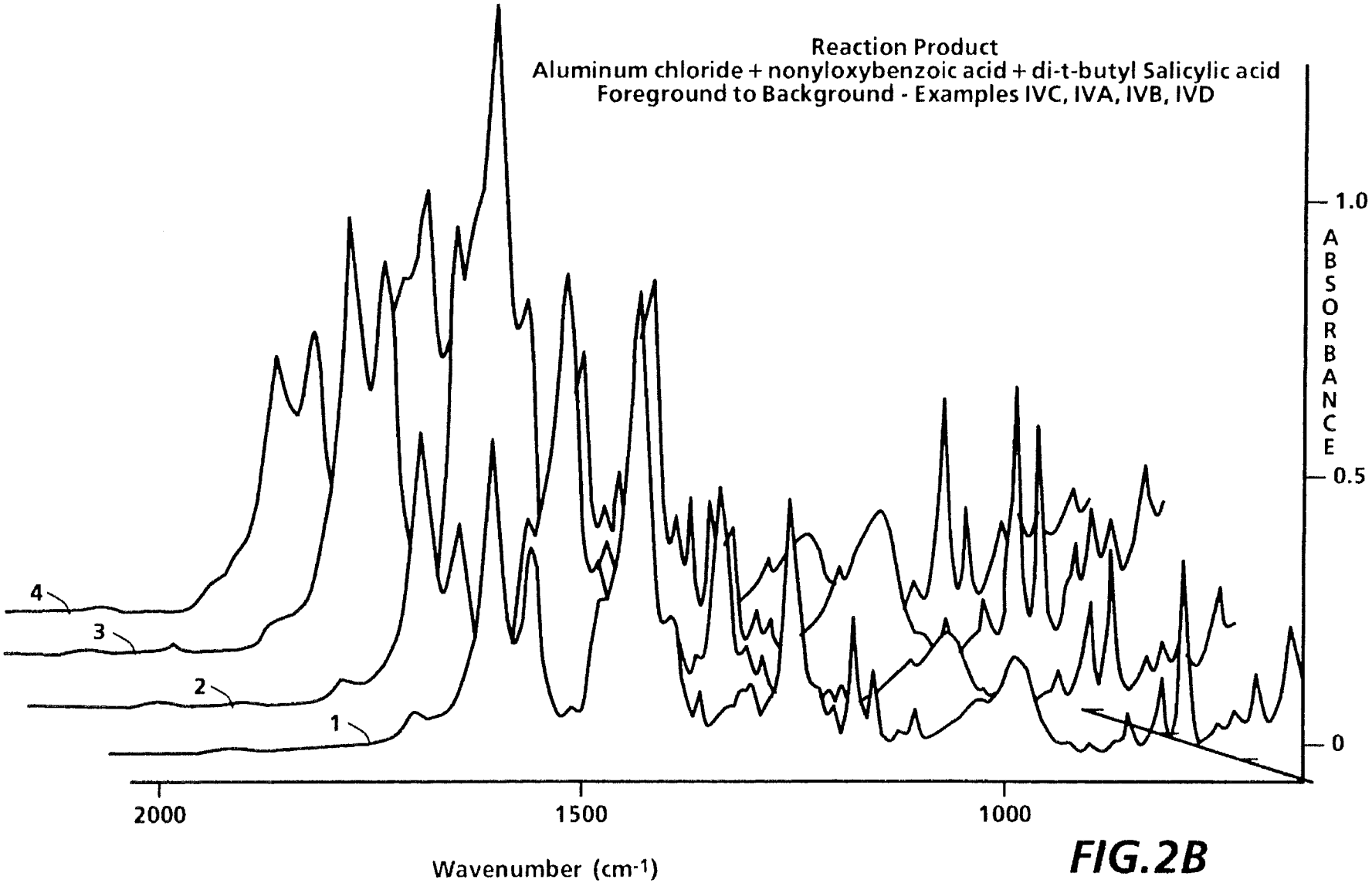
Figure 3:
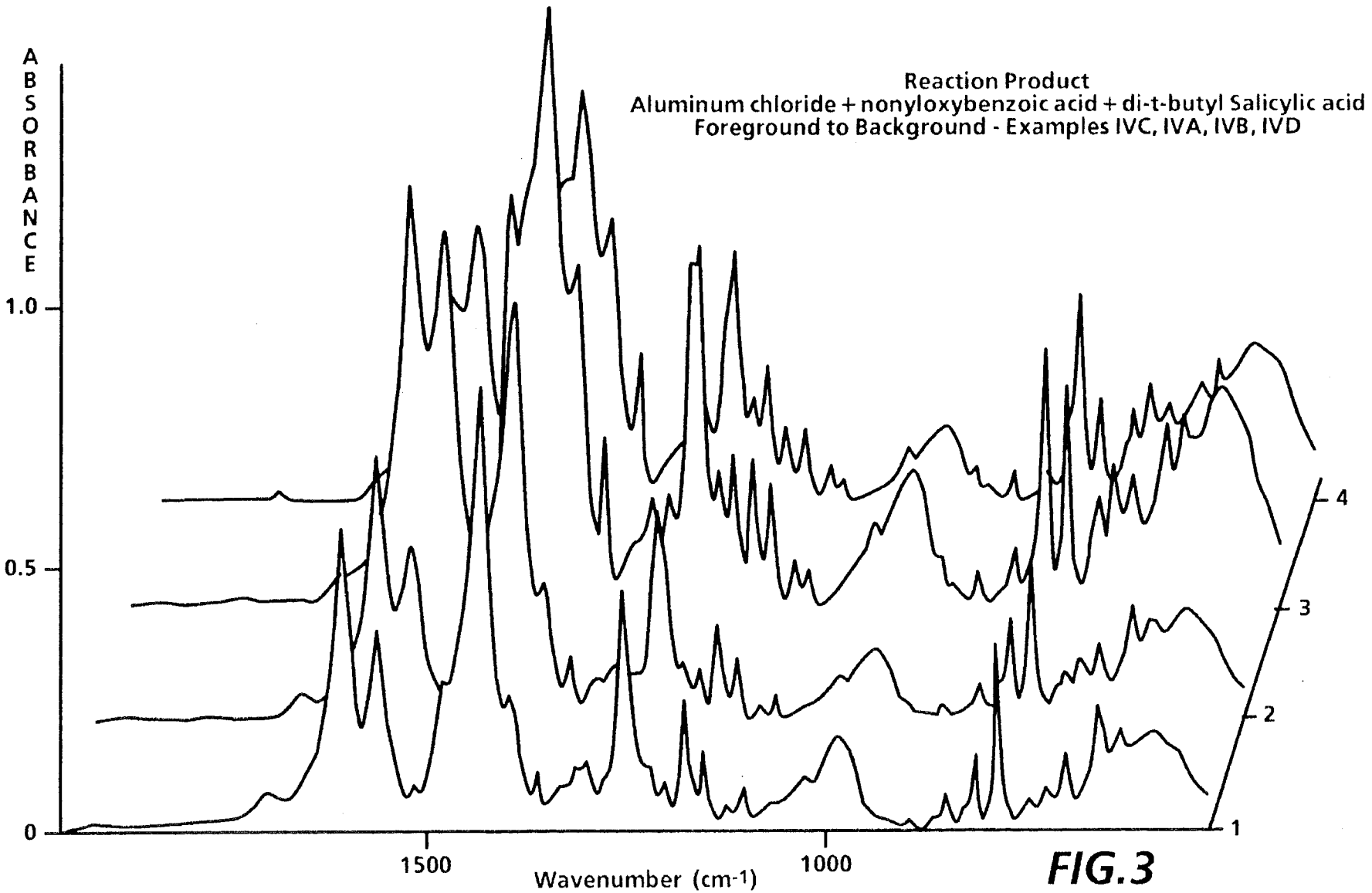
Figure 4:
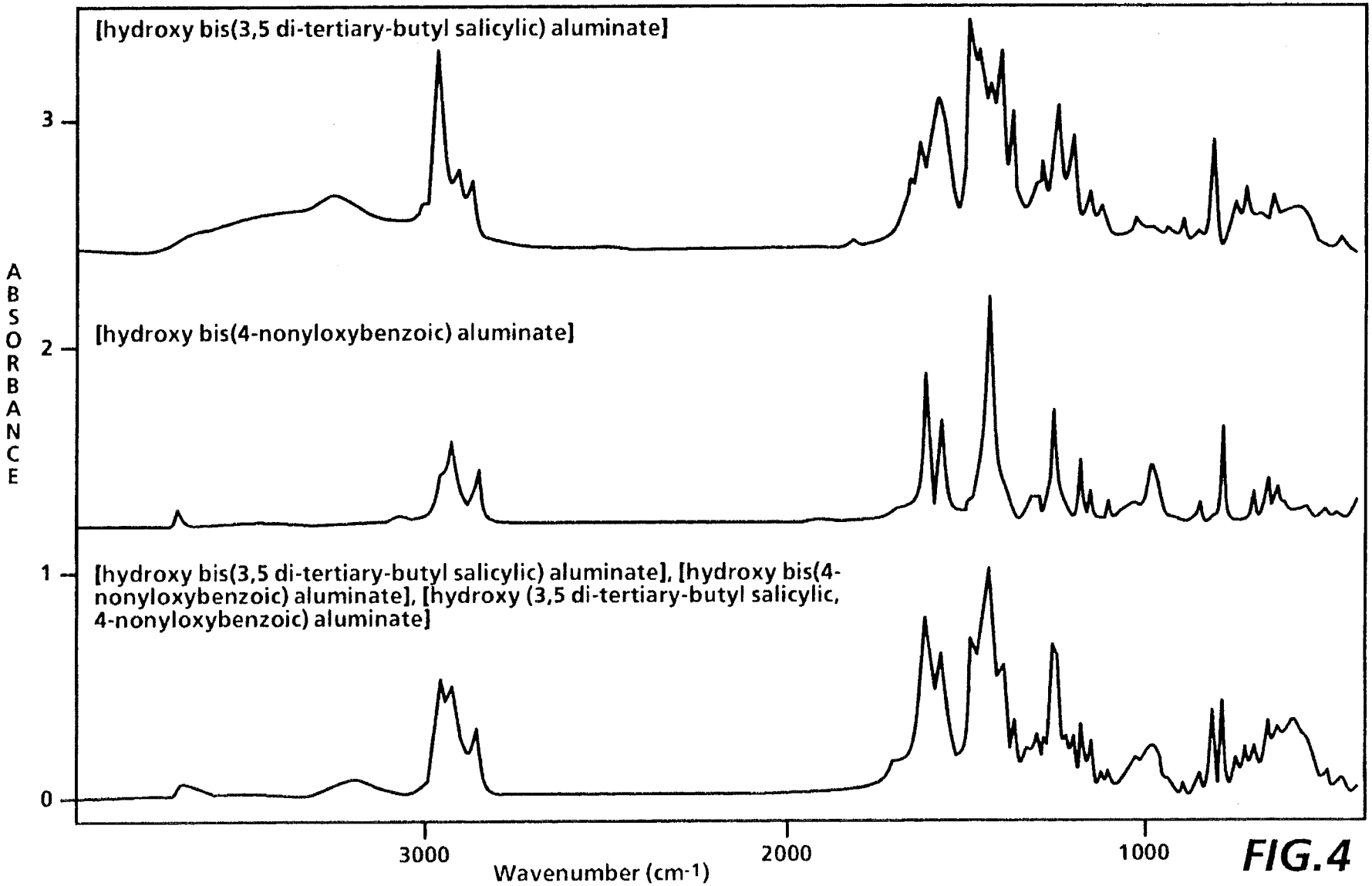

It is a object of the present invention to provide toner and developer compositions.

In another object of the present invention there are provided negatively charged toners useful in discharge area development, charged area development, hybrid scavengeless, and the like.

Another object of the present invention resides in the provision of toners with certain charge enhancing additive mixtures.

Moreover, in another object of the present invention there are provided strongly negatively charged toners, and wherein the mixture of charge additives thereof can also function as a toner lubricant.

These and other objects of the present invention can be accomplished by the provision of toners with certain charge enhancing additives. More specifically, the present invention is directed to a toner comprised of resin particles, pigment particles, and a charge enhancing additive that is comprised of a mixture of components of the following formulas wherein $R_1$ is alkoxy, $R_2$ is alkyl, n represents the number of segments, and N is a number of about 1 to 3.

FORMULA 1

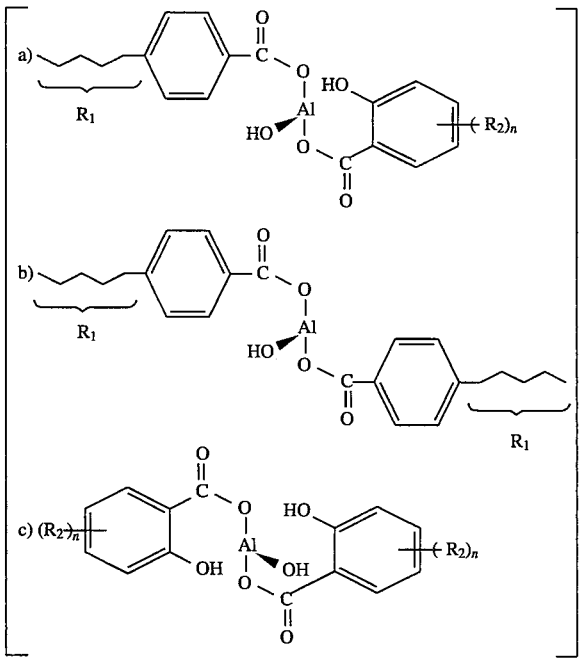

The mixture contains, for example, effective amounts of each component. The reactivities of the starting acids are expected to be very close, if not identical, and by solublizing the acids within the same solution the three components of the mixture as represented by Formula 1 can be expected. For example, one final product can contain the following concentrations as determined by kinetics and statistics, approximately 62.5 percent by weight of the b) component of Formula 1 and 12.5 percent by weight of the c) component if the starting acid solution contained 3 molar parts of alkoxy acid to 1 molar part alkylsalicylic acid. The remaining 25 percent by weight of the product is the combined aluminum salt of the combined starting acids as represented by the a) component of Formula 1. The preferred reaction selects a 1:1 molar ratio which results in a product that contains 25 percent by weight of the b) and c) components and 50 percent by weight of the combined salt. The relative changes in the concentrations of the components of the product can be seen in the Infrared of the various products.

Examples of charge component additive present in the mixture, reference the above Formulas, include:

a) {[hydroxy bis(3,5-di-tertiary-butyl salicylic) aluminate], [hydroxy bis(4-nonyloxybenzoic) aluminate], [hydroxy (3,5-di-tertiary-butyl salicylic, 4-nonyloxybenzoic) aluminate]};

b) {[hydroxy bis(3,5-di-isopropyl salicylic) aluminate], [hydroxy bis(4-nonyloxybenzoic) aluminate], [hydroxy (3,5-di-tertiary-butyl salicylic, 4-nonyloxybenzoic) aluminate]};

c) {[hydroxy bis(3,5-di-tertiary-butyl salicylic) aluminate], [hydroxy bis(4-dodecyloxybenzoic) aluminate], [hydroxy (3,5-di-tertiary-butyl salicylic, 4-dodecyloxybenzoic) aluminate]};

d) {[hydroxy bis(3,5-di-tertiary-butyl salicylic) aluminate], [hydroxy bis(4-decyloxybenzoic) aluminate], [hydroxy (3,5-di-tertiary-butyl salicylic, 4-decyioxybenzoic) aluminate]};

e) {[hydroxy bis(nonyl salicylic) aluminate], [hydroxy bis(4-dodecyloxybenzoic) aluminate], [hydroxy (nonyl salicylic, 4-dodecyloxybenzoic) aluminate]};

f) {[hydroxy bis(3,5-di-tertiary-butyl salicylic) aluminate], [hydroxy bis(4-heptyloxybenzoic) aluminate], [hydroxy (3,5-di-tertiary-butyl salicylic, 4-heptyloxybenzoic) aluminate]}; and g) {[hydroxy bis(nonyl salicylic) aluminate], [hydroxy bis(4-nonyloxybenzoic) aluminate], [hydroxy (nonyl salicylic, 4-nonyloxybenzoic) aluminate]}.

The toners of the present invention in embodiments thereof are comprised of resin particles, pigment particles, such as known carbon blacks, including those available from Cabot Corporation, such as REGAL 330® carbon black, Vulcan carbon blacks and the like available from Cabot Corporation, colored pigments other than black, such as magenta, cyan, yellow, or mixtures thereof, and the charge additive mixture.

The charge additive mixture is present in the toner in various effective amounts, for example from about 0.05 to about 20, and preferably from about 0.5 to about 5 weight percent. The charge additive mixture of the present invention may in embodiments also be added to the surface of the toner particles or may be included on the toner particles by adding the charge additive mixture onto the surface of small particle metal oxide particles, for example silicon oxides, tin oxides, aluminum oxides, zinc oxides, cerium oxides, titanium oxides, and the like. The toner can possess a negative triboelectic charge of from about 10 to about 40, and preferably from about 20 to about 35 microcoulombs per gram as determined by the known Faraday Cage process.

The following reaction illustrates the preparation of the charge control additive mixture of the present invention where the desired final product can be represented by the structures illustrated in Formula 1 wherein, for example, $R_1$ is an alkoxy group with 6 to 20 carbons; $R_2$ is an alkyl group of 3 to 20 carbons, and n=1, 2, or 3. Known molar amounts of the alkoxy benzoic acid and alkyl salicylic acid are dissolved in a hot aqueous solution of a known base such as sodium hydroxide. The starting molar ratios can range from 3:1 of the alkoxy benzoic acid to alkyl salicylic acid to 1:3 of the alkoxy benzoic acid to alkyl salicylic acid. This hot solution is reacted with a hot aqueous aluminum salt solution such as aluminum chloride, aluminum sulfate, and the like. The ratio of the reactants is such that there are 2 molecules of the acids for every molecule of aluminum. The reaction can be accomplished at temperatures ranging from about 75° C. to about 95° C. The resulting precipitate is filtered and washed with clean water and dried. The product can generally be identified by various known means such as infrared analysis. The product contains a mixture of materials as represented by Formula 1, the ratio of each component of the mixture being dependent upon the ratio of the starting acids, which changing ratio is illustrated by infrared analysis.

In an embodiment of the present invention, the imaging process comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a negatively charged first toner comprised of resin particles, colored, other than black, pigment particles, and the charge enhancing additive mixture illustrated herein; (4) subsequently developing the high areas of potential by conductive magnetic brush development with a developer comprising a second black developer comprised of carrier particles and a positively charged toner comprised of resin, black pigment, such as carbon black, like those available from Cabot Corporation, such as REGAL 330®, and a second charge enhancing additive that assists in enabling a positive charge on the toner, such as distearyl dimethyl ammonium methyl sulfate; (5) transferring the developed two-color image to a suitable substrate; and (6) fixing the image thereto. Also, black latent images can be developed with the toners of the present invention.

Toner resin examples include known polymers such as those illustrated herein, and in the U.S. patents mentioned herein, such as styrene acrylates, styrene methacrylates, crosslinked styrene acrylates, styrene methacrylates, wherein the crosslinking component can, for example, be a divinylbenzene, polyesters especially reactive extruded polyesters, reference U.S. Pat. No. 5,376,494 . Also, known suspension polymerized styrene butadienes and emulsion polymerized styrene butadienes may be selected as the toner resin. These resins are selected in various effective amounts such as from about 75 to about 90 percent by weight.

Carriers that may be selected to form the developers include those comprised of cores of steel, ferrites, such as copper zinc ferrites, other known ferrites, iron, sponge iron, and the like. The carrier cores may be coated with an effective amount of polymers, either with a continuous or semicontinuous coating, wherein the coating weight in embodiments is from about 0.1 to about 3 weight percent. Examples of coatings include fluoropolymers, such as KYNAR®, terpolymers of styrene, methacrylate and an organosilane, chlorotrifluoroethylene-vinyl chloride copolymers, chlorotrifluoroethylene-vinylacetate copolymers, polymethacrylate, and the like. Also, there may be selected the carriers of U.S. Pat. Nos. 4,937,166 and 4,935,326, the disclosures of which are totally incorporated herein by reference.

Examples of imaging members selected for the processes of the present invention in embodiments may be of any type capable of maintaining three distinct levels of potential; layered imaging members with a charge generating and a charge transport layer, reference U.S. Pat. Nos. 4,265,990; 4,585,884; 4,584,253; 4,563,408 and the like, the disclosures of which are totally incorporated herein by reference; selenium, selenium alloys and the like. Also, various dielectric or photoconductive insulating material suitable for use in xerographic, ionographic, or other electrophotographic processes may be used, such as amorphous silicon. Further, the imaging members of U.S. Pat. No. 4,265,990 may be selected, especially for the formation and development of black images.

In addition, external additives of colloidal silica, such as AEROSIL R972®, AEROSIL R976®, AEROSIL R812®, and the like, available from Degussa, and metal salts or metal salts of fatty acids, such as zinc stearate, magnesium stearate, aluminum stearate, cadmium stearate, and the like, may be blended on the surface of the colored and black toners. Toners with these additives blended on the toner surface are disclosed in the prior art, such as U.S. Pat. Nos. 3,590,000; 3,720,617; 3,900,588 and 3,983,045, the disclosures of each of which are totally incorporated herein by reference. Generally, the silica is present in an amount of from about 0.1 to about 2 percent by weight, and preferably about 0.3 percent by weight of the toner, and the stearate is present in an amount of from about 0.1 to about 2 percent by weight, and preferably about 0.3 percent by weight of the toner. Varying the amounts of these two external additives enables adjustment of the charge levels and conductivities of the toners. For example, increasing the amount of silica generally adjusts the triboelectric charge in a negative direction and improves admix times, which are a measure of the amount of time required for fresh toner to become triboelectrically charged after coming into contact with the carrier. In addition, increasing the amount of stearate improves admix times, renders the developer composition more conductive, adjusts the triboelectric charge in a positive direction, and improves humidity insensitivity.

Developer compositions selected for the processes of the present invention generally comprise various effective amounts of carrier and toner. Generally, from about 0.5 to about 5 percent by weight of toner and from about 95 to about 99.5 percent by weight of carrier are admixed to formulate the developer.

The black toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number from about 30 to about 300, and preferably from about 30 to about 50, reference U.S. Pat. No. 4,883,736, the disclosure of which is totally incorporated herein by reference. Linear polymeric alcohols of this type are generally available from Petrolite Chemical Company as UNILIN™. The linear polymeric alcohol is generally present in an amount of from about 0.1 to about 1 percent by weight of the toner.

Developer compositions for the present invention in embodiments comprise from about 1 to about 5 percent by weight of the toner and from about 95 to about 99 percent by weight of the carrier. The ratio of toner to carrier may vary. For example, an imaging apparatus employed for the process of the present invention may be replenished with a colored developer comprising about 65 percent by weight of toner and about 35 percent by weight of carrier. The triboelectric charge of the black toners generally is from about −10 to about −30, and preferably from about −13 to about −18 microcoulombs per gram. Particle size of the black toners is generally from about 8 to about 13 microns in volume average diameter, and preferably about 11 microns in volume average diameter, although the value may be outside of this range, provided that the objectives of the present invention are achieved.

Coating of the carrier particles of the present invention may be by any suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling, or fluid bed coating in which the carrier particles are blown into the air by means of an air stream; and an atomized solution comprising the coating material and a solvent is sprayed onto the airborne carrier particles repeatedly until the desired coating weight is achieved.

The toners of the present invention may be prepared by processes, such as extrusion, which is a continuous process that entails dry blending the resin, pigment, and charge control additive mixture, placing them into an extruder, melting and mixing the mixture, extruding the material, and reducing the extruded material to pellet form. The pellets can be further reduced in size by grinding or jetting, and are then classified by particle size. In an embodiment of the present invention, toner compositions with an average particle size of from about 10 to about 25, and preferably from 10 to about 15 microns can be selected. External additives, such as linear polymeric alcohols, silica, or zinc stearate, can then be blended with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention. Other known toner preparation processes can be selected including melt mixing of the components in, for example, a Banbury, followed by cooling, attrition and classification.

The colored and black toners can be comprised of the same or similar toner resins, pigments, and surface additives, and in the same or similar amount ranges, or specific amounts indicated herein. Also, the toners of the present invention can be selected for discharge area development, hybrid scavengeless development, conductive magnetic brush, and the like.

Specific embodiments of the invention will now be described in detail. These Examples are intended to be illustrative, and the invention is not limited to the materials, conditions, or process parameters set forth in these embodiments. All parts and percentages are by weight unless otherwise indicated. A Comparative Example is also provided.

EXAMPLE I

Synthesis of Aluminum Salt Mixture of 3,5-Di-t-butylsalicylic Acid and 4-Nonyloxybenzoic Acid To a first solution of 1.02 gram (0.0255 mole) of NaOH in 75 milliliters of distilled hot water were added 2.26 grams of 4-nonyloxybenzoic acid (0.0085 mole) and 2.14 grams of 3,5-di-t-butylsalicylic acid (0.0085 mole). The resulting mixture was heated and stirred until all of the acids dissolved. The temperature of the solution was maintained at least 85° C. A second solution was prepared by dissolving 2.05 grams of $AlCl_3.6H_2O$ in 30 milliliters of water. This second solution was heated to >75° C. The first solution was added dropwise (fast drip) with stirring to the heated second solution. A white precipitate forms immediately. When the addition is completed, the reaction mixture was stirred an additional 10 to 20 minutes at 85° C. and then cooled to room temperature, about 25° C. The mixture was then filtered, and the collected solid product was washed first with hot water and then with room temperature water until the acidity of the used wash water was about 5.5. The solids were dried in a vacuum oven at 120° F. to a constant weight to afford 4.33 grams of white product (0.0078 mole, 91.5 percent of theory). When a sample, about 1.4 gram, it is believed, of the product obtained was analyzed for water by Karl-Fischer titration after drying for an additional 12 hours at 100° C. in a vacuum, the sample contained 4.34 percent by weight of water. The theoretical value calculated for a one mole of water with the product is 3.13 percent by weight of water.

The Infrared spectrum of the above product indicated the formation of an aluminum salt supported by the loss of carboxylic acid hydrogen bands in the 2,500 $cm^{-1}$ to 2,700 $cm^{-1}$ region, and the carbonyl band shifts from 1,687 $cm^{-1}$ and 1,647 $cm^{-1}$ to 1,563 $cm^{-1}$ when compared to spectrums of the starting acids. There was also an appearance of an aluminum hydroxyl band at 3,676 $cm^{-1}$ not seen in the starting materials.

Elemental Analysis for $C_{31}H_{45}O_7Al$, reference FIG. 1.

Calculated: C, 66.87; H, 8.16; Al, 4.85.

Elemental Analysis for $C_{31}H_{45}O_7Al.H_2O$

Calculated: C,64.78; H,8.26; Al, 4.69.

Found: C, 66.55; H, 8.20; Al, 4.34.

EXAMPLE II

Synthesis of Aluminum Salt Mixture of 3,5-Di-t-butylsalicylic Acid and 4-Heptyloxybenzoic Acid The processes of Example I were repeated using the following materials and amounts: 1.02 gram of NaOH (0.0255 mole), 100 milliliters of $H_2O$, 2.02 grams of 4-heptyloxybenzoic acid (0.0085 mole) and 2.14 grams of 3,5-di-t-butylsalicylic acid (0.0085 mole) for solution 1 and 2.05 grams of $AlCl_3.6H_2O$ in 50 milliliters of water for solution 2. 4.22 Grams of product {[hydroxy bis(3,5-di-tertiary-butyl salicylic) aluminate], [hydroxy bis(4-heptyloxybenzoic) aluminate], [hydroxy (3,5-di-tertiary-butyl salicylic, 4-heptyloxybenzoic) aluminate]} were recovered and analyzed by IR.

EXAMPLE III

Synthesis of Aluminum Salt Mixture of Nonylsalicylic Acid and 4-Nonyloxybenzoic Acid The processes of Example I were repeated using the following materials and amounts: 1.20 grams of NaOH, 200 milliliters of $H_2O$, 2.64 grams of 4-nonyloxybenzoic acid and 2.64 grams of nonylsalicylic acid for solution 1, and 2.41 grams of $AlCl_3.6H_2O$ in 75 milliliters of water for solution 2. 5.21 Grams of product were recovered and analyzed by IR indicating formation of a product mixture with three components {[hydroxy bis(nonyl salicylic) aluminate], [hydroxy bis(4-nonyloxybenzoic) aluminate], and [hydroxy (nonyl salicylic, 4-nonyloxybenzoic) aluminate]}.

EXAMPLE IVA

Synthesis of Aluminum Salt Mixture of 3,5-Di-t-butylsalicylic Acid and 4-Nonyloxybenzoic Acid, No. 2:

To a first solution of 1.89 grams (0.0473 mole) of NaOH in 130 milliliters of distilled hot water were added 5.0 grams of 4-nonyloxybenzoic acid (0.0189 mole) and 3.15 grams of 3,5-di-t-butylsalicylic acid (0.0126 mole). The resulting mixture was heated and stirred until all of the acids dissolved. The temperature of the solution maintained >75° C. A second solution was prepared by dissolving 3.80 grams of $AlCl_3.6H_2O$ in 50 milliliters of water. This second solution is heated to >75° C. The first solution was added dropwise (fast drip) with stirring to the heated second solution. A white precipitate forms immediately. When the addition is completed, the reaction mixture was stirred an additional 10 to 20 minutes at 85° C. and then cooled to room temperature, about 25° C. The mixture was then filtered, and the collected solid product was washed first with hot water and then with room temperature water until the acidity of the used wash water was about 5.5. The solids were dried in a vacuum oven at 120° F. to a constant weight to afford 8.21 grams of white product mixture of {[hydroxy bis(3,5-di-tertiary-butyl salicylic) aluminate], [hydroxy bis(4-nonyloxybenzoic) aluminate], and [hydroxy (3,5-di-tertiary-butyl salicylic, 4-nonyloxybenzoic) aluminatel}.

EXAMPLE IVB

Synthesis of Aluminum Salt Mixture of 3,5-Di-t-butylsalicylic Acid and 4-Nonyloxybenzoic Acid, No. 3

The processes of Example IVA were repeated using the following amounts: 1.89 grams of NaOH, 130 milliliters of $H_2O$, 3.33 grams of 4-nonyloxybenzoic acid (0.0126 mole) and 4.73 grams of 3,5-di-t-butylsalicylic acid (0.0189 mole) for solution 1, and 3.80 grams of $AlCl_3.6H_2O$ in 50 milliliters of water for solution 2. 8.20 Grams of a product mixture of three components of {[hydroxy bis(3,5-di-tertiary-butyl salicylic) aluminate], [hydroxy bis(4-nonyloxybenzoic) aluminate], and [hydroxy (3,5-di-tertiary-butyl salicylic, and 4-nonyloxybenzoic) aluminate]} were recovered.

EXAMPLE IVC

Synthesis of Aluminum Salt Mixture of 3,5-Di-t-butylsalicylic Acid and 4-Nonyloxybenzoic Acid, No. 4

The processes of Example IVA were repeated using the following amounts: 1.51 grams of NaOH (0.0378 mole), 130 milliliters of $H_2O$, 1.67 grams of 4-nonyloxybenzoic acid (0.0063 mole) and 4.73 grams of 3,5-di-t-butylsalicylic acid (0.0189 mole) for solution 1, and 3.04 grams of $AlCl_3.6H_2O$ in 50 milliliters of water for solution 2. 6.98 Grams of a product mixture of {[hydroxy bis(3,5-di-tertiary-butyl salicylic) aluminate], [hydroxy bis(4-nonyloxybenzoic) aluminate], and [hydroxy (3,5-di-tertiary-butyl salicylic, 4-nonyloxybenzoic) aluminate]} were recovered.

EXAMPLE IVD

Synthesis of Aluminum Salt Mixture of 3,5-Di-t-butylsalicylic Acid and 4-Nonyloxybenzoic Acid, No. 5

The processes of Example IVA were repeated using the following amounts: 1.51 grams of NaOH (0.0378 mole), 130 milliliters of $H_2O$, 5.00 grams of 4-nonyloxybenzoic acid (0.0189 mole) and 1.58 grams of 3,5-di-t-butylsalicylic acid (0.0063 mole) for solution 1, and 3.04 grams of $AlCl_3.6H_2O$ in 50 milliliters of water for solution 2. 6.84 Grams of a product mixture of {[hydroxy bis(3,5-di-tertiary-butyl salicylic) aluminate], [hydroxy bis(4-nonyloxybenzoic) aluminate], [hydroxy (3,5-di-tertiary-butyl salicylic, 4-nonyloxybenzoic) aluminate]} were recovered. The concentration of each of the three compounds that make up this mixture is different than the concentrations of the same components in Examples I, IVA, IVB and IVC. Infrared analysis of the materials recovered in Examples VIA to D shows that the overall spectral features for each sample is nearly identical with respect to wavenumber and profile, however, intensities vary significantly with changes in the starting acid ratio. No unreacted or unassociated starting free acid was detected in these samples as supported by the loss of the acid hydrogen bands in the 2,500 $cm^{-1}$ to 27,000 $cm^{-1}$ region, and the carbonyl shifts from that observed in the spectra of the pure starting acids.

EXAMPLE V

A toner was prepared as follows: 98.0 parts of bisphenol fumarate polyester resin (SPAR™) obtained from Resana, and 2.0 parts of PV FAST BLUE® pigment obtained from Hoechst Celanese were melt blended in an extruder followed by micronization and air classification to yield toner sized particles of 10 microns in volume average diameter. Carrier particles were prepared by solution coating a Hoeganoes Anchor Steel core with a particle diameter range of from about 75 to about 150 microns, available from Hoeganoes Company, with 1 part by weight of a coating comprising 20 parts by weight of VULCAN® carbon black, available from Cabot Corporation, homogeneously dispersed in 80 parts by weight of polymethylmethacrylate, which coating was solution coated from toluene. A developer was prepared by selecting 3 parts of the above prepared toner and blending it with 100 parts of the above prepared carrier by roll milling for a period of about 30 minutes which resulted in a developer with a toner exhibiting a triboelectric charge of 9.7 microcoulombs per gram as measured in a Faraday Cage.

EXAMPLE VI

A toner was prepared as follows: 97.0 parts of bisphenol fumarate polyester resin, 2.0 parts of PV FAST BLUE® pigment, and 1.0 part of the hydroxy aluminum mixture of Example I were melt blended in an extruder followed by micronization and air classification to yield toner size particles of 10 microns in volume average diameter. A developer was prepared by repeating the process of Example V. The resulting developer exhibited a triboelectric charge of −14.7 microcoulombs per gram. A charge spectrograph analysis of the toner measured at 125 volts/centimeter resulted in a 15 second admix.

EXAMPLE VII

A toner was prepared by repeating the process of Example VI except that 3 parts of the hydroxy aluminum compound of Example I were used. A developer was prepared by repeating the process of Example V. The resulting developer exhibited a triboelectric charge of −21 microcoulombs per gram. A charge spectrograph analysis of the developer (toner) measured at 125 volts/centimeter resulted in a 15 second admix.

EXAMPLE VIII

The toner of Example V was surface blended with 0.2 weight percent of the hydroxy aluminum compound of Example I. A developer was prepared by repeating the process of Example V. The resulting developer exhibited a triboelectric charge of −31.5 microcoulombs per gram. This procedure was repeated except that 0.5 weight percent of the hydroxy aluminum compound of Example I was used. A developer was prepared by repeating the process of Example V. The resulting toner exhibited a triboelectric charge of −31.9 microcoulombs per gram.

EXAMPLE IX

A toner was prepared as in Example V except 4.0 parts of FANAL PINK™ pigment from BASF Corporation were used in place of the PV FAST BLUE™. A developer was prepared by repeating the process of Example V. The resulting developer exhibited a triboelectric charge of −1.0 microcoulomb per gram. The surface of this toner was then blended with 0.2 weight percent of the hydroxy aluminum compound of Example I. A developer was prepared by repeating the process of Example V. The resulting developer exhibited a triboelectric charge of −16 microcoulombs per gram. This procedure was repeated except that 0.5 weight percent of the hydroxy aluminum compound of Example I was used. A developer was prepared by repeating the process of Example V. The resulting toner exhibited a triboelectric charge of −21.3 microcoulombs per gram.

EXAMPLE X

A toner was prepared as in Example VIII except that 0.2 weight percent of the aluminum compound of 3,5-di-t-butylsalicylic acid prepared according to U.S. Pat. No. 4,845,003 was used in place of the hydroxy aluminum compound of Example I. A developer was prepared by repeating the process of Example V. The resulting toner exhibited a triboelectric charge of −23.0 microcoulombs per gram.

EXAMPLE XI

A toner was prepared as in Example IX except that 0.2 weight percent of the aluminum compound of 3,5-di-t-butylsalicylic acid prepared according to U.S. Pat. No. 4,845,003 was used in place of the hydroxy aluminum compound of Example I. A developer was prepared by repeating the process of Example V. The resulting developer exhibited a triboelectric charge of −11.1 microcoulombs per gram. This procedure was repeated except that 0.5 weight percent of the hydroxy aluminum compound of 3,5-di-t-butylsalicylic acid prepared according to U.S. Pat. No. 4,845,003 was used. A developer was prepared by repeating the process of Example V. The resulting developer (toner) exhibited a triboelectric charge of −14.2 microcoulombs per gram.

EXAMPLE XII

The toner from Example V is surface blended with 0.2 weight percent of the hydroxy aluminum compound of Example II. A developer was prepared by repeating the process of Example V. The resulting toner exhibited a triboelectric charge of −33.3 microcoulombs per gram.

EXAMPLE XIII

The toner of Example V was surface blended with 0.2 weight percent of the hydroxy aluminum compound of Example III. A developer was prepared by repeating the process of Example V. The resulting toner exhibited a triboelectric charge of −15.6 microcoulombs per gram. This procedure was repeated except that 0.5 weight percent of the hydroxy aluminum compound of Example III was used. A developer was prepared by repeating the process of Example V. The resulting toner exhibited a triboelectric charge of −22.5 microcoulombs per gram.

EXAMPLE XIVA

The toner of Example V was surface blended with 0.5 weight percent of the hydroxy aluminum compound of Example IVA. A developer was prepared by repeating the process of Example V. The resulting developer exhibited a triboelectric charge of −23.8 microcoulombs per gram. This procedure was repeated except that the toner from Example IX was used. A developer was prepared by repeating the process of Example V. The resulting toner exhibited a triboelectric charge of −20.1 microcoulombs per gram.

EXAMPLE XIVB

The toner of Example V was surface blended with 0.5 weight percent of the hydroxy aluminum compound of Example IVB. A developer was prepared by repeating the process of Example V. The resulting developer exhibited a triboelectric charge of −26.9 microcoulombs per gram. This procedure was repeated except that the toner of Example IX was used. A developer was prepared by repeating the process of Example V. The resulting toner exhibited a triboelectric charge of −20.3 microcoulombs per gram.

EXAMPLE XIVC

The toner of Example V was surface blended with 0.5 weight percent of the hydroxy aluminum compound of Example IVC. A developer was prepared by repeating the process of Example V. The resulting toner exhibited a triboelectric charge of −25.5 microcoulombs per gram. This procedure was repeated except that the toner from Example IX was used. A developer was prepared by repeating the process of Example V. The resulting toner exhibited a triboelectric charge of −18.4 microcoulombs per gram.

EXAMPLE XIVD

The toner of Example V was surface blended with 0.5 weight percent of the hydroxy aluminum compound of Example IVD. A developer was prepared by repeating the process of Example V. The resulting developer exhibited a triboelectric charge of −17.2 microcoulombs per gram. This procedure was repeated except that the toner of Example IX was used. A developer was prepared by repeating the process of Example V. The resulting developer exhibited a triboelectric charge of −3.0 microcoulombs per gram. The tribo results of Examples IVA to D above illustrate that by varying the ratio of starting acids in the synthesis the tribo of the resulting toner product can be altered.

EXAMPLE XV

The toner of Example V was surface blended with 0.3 weight percent of zinc stearate obtained from Synthetic Products Company, 0.55 weight percent of TS530, a hexamethyldisilizane treated fumed silica obtained from Cabot Corporation and 0.2 weight percent of the compound synthesized in Example I. Two developers were prepared by repeating the process of Example V and one acclimated (stored in a chamber) at 80 percent RH for a period of about 24 hours, and the other acclimated (stored in a chamber) at 20 percent RH for a period of about 24 hours. The resulting developers exhibited triboelectric charges of −21.3 microcoulombs per gram and −30.9 microcoulombs per gram, respectively.

COMPARATIVE EXAMPLE XVI

A toner was prepared by essentially repeating the processes of Example XV except that 0.2 weight percent of a 50/50 mixture of the aluminum compound hydroxy bis-3,5-di-t-butylsalicylic aluminate and hydroxy bis-4-nonyloxybenzoic acid aluminate prepared according to U.S. Pat. No. 4,845,003, the disclosure of which is totally incorporated herein by reference, was used in place of the compound synthesized in Example I. Two developers were prepared by repeating the process of Example V and one acclimated at 80 percent RH for a period of about 24 hours, and the other acclimated at 20 percent RH for a period of about 24 hours. The resulting toner exhibited a triboelectric charge of −16.8 microcoulombs per gram and −27.2 microcoulombs per gram, respectively.

COMPARATIVE EXAMPLE 1

Synthesis of Hydroxy Bis-3,5-Tertiary Butyl Salicylic Aluminate

To a first solution of 12 grams (0.3 mole) of NaOH in 500 milliliters of distilled hot water were added 50 grams 3,5-di-t-butylsalicylic acid (0.2 mole). The resulting mixture was heated and stirred until all of the acid dissolved. The temperature of the solution was maintained at least at 60° C. A second solution was prepared by dissolving 33.37 grams of $Al_2(SO_4)_3.18H_2O$ in 200 milliliters of water. This second solution was heated to 60° C. The first solution was added dropwise (fast drip) with stirring to the heated second solution. A white precipitate formed immediately. When the addition was completed, the reaction mixture was stirred an additional 10 to 20 minutes at 85° C. and then cooled to room temperature, about 25° C. The mixture was then filtered and the collected solid product was washed first with hot water and then with room temperature water until the acidity of the used wash water was about 5.5. The solids were dried in a vacuum oven at 120° F. to a constant weight to afford 52 grams of white product. The above procedure is as illustrated in U.S. Pat. No. 5,223,368, the disclosure of which is totally incorporated herein by reference.

COMPARATIVE EXAMPLE 2

Synthesis of Hydroxy Bis-4-nonyloxybenzoic Aluminate

To a first solution of 1.13 grams of NaOH in 75 milliliters of distilled hot water were added 5 grams 4-nonyloxybenzoic acid. The resulting mixture was heated and stirred until all of the acid dissolved. The temperature of the solution was maintained at least 80° C. A second solution was prepared by dissolving 2.28 grams of $AlCl_3.6H_2O$ in 50 milliliters of water. This second solution was heated to 80° C. The first solution was added dropwise (fast drip) with stirring to the heated second solution. A white precipitate formed immediately. When the addition was completed, the reaction mixture was stirred an additional 10 to 20 minutes at 90° C. and then cooled to room temperature, about 25° C. The mixture was then filtered, and the collected solid product was washed first with hot water and then with room temperature water until the acidity of the used wash water was about 5.5. The solids were dried in a vacuum oven at 120°

F. to a constant weight to afford 4.61 grams of white product.

COMPARATIVE EXAMPLE 3

A toner was prepared by essentially repeating the processes of the above Examples except that 0.2 weight percent of the aluminum compound 3,5-di-t-butylsalicylic acid prepared according to U.S. Pat. No. 4,845,003, the disclosure of which is totally incorporated herein by reference, was used in place of the compound synthesized in Example I. Two developers were then prepared by repeating the process of Example V and one acclimated at 80 percent RH for a period of about 24 hours, and the other acclimated at 20 percent RH for a period of about 24 hours. The resulting developers exhibited triboelectric charges of −16.8 microcoulombs per gram and −27.2 microcoulombs per gram, respectively.

COMPARATIVE EXAMPLE 4

The toner of Example V was surface blended with 0.2 weight percent of a 50/50 dry blend of the aluminum compound synthesized in Comparative Example 1 and the aluminum compound synthesized in Comparative Example 2. A developer was prepared by repeating the process of Example V. The resulting developer exhibited a triboelectric charge of −24.2 microcoulombs per gram. This procedure was repeated except that 0.5 weight percent of the 50/50 dry blend of the two aluminum compounds was used. A developer was prepared by repeating the process of Example V. The resulting developer exhibited a triboelectric charge of −25.7 microcoulombs per gram. These tribos are significantly lower than observed in Example VIII.

In embodiments of the present invention, the charge additives may be comprised of mixtures of the unhydrated and hydrated components.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner composition comprised of resin, pigment and a charge additive mixture of components of the formulas

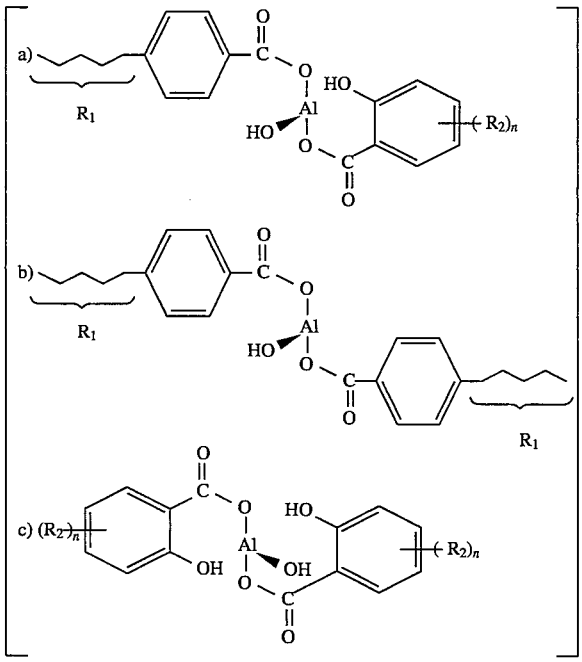

wherein $R_1$ is an alkoxy group, $R_2$ is an alkyl group, and n is an integer of 1 to 3.

2. A toner in accordance with claim 1 wherein alkoxy contains from about 6 to about 20 carbon atoms and alkyl contains from about 3 to about 20 carbon atoms.

3. A toner in accordance with claim 1 wherein $R_1$ is the alkoxy group nonyloxy, heptyloxy, dodecyloxy, or decyloxy, and $R_2$ is the alkyl group butyl, isopropyl, nonyl or dodecyl.

4. A toner composition comprised of resin, pigment and a charge additive mixture of the formulas

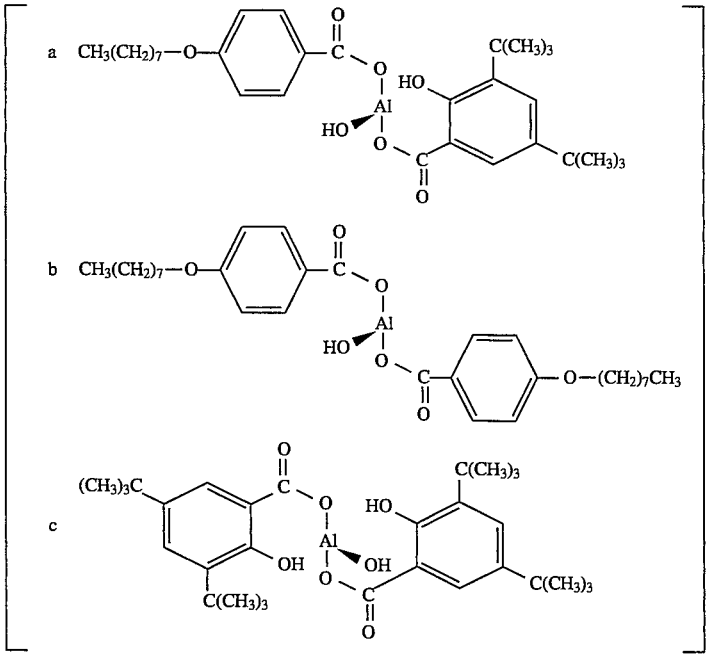

-continued
a
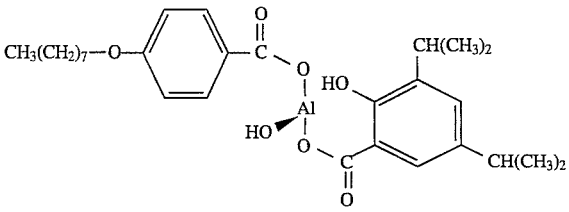
b
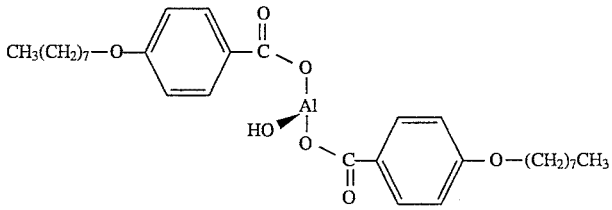
c
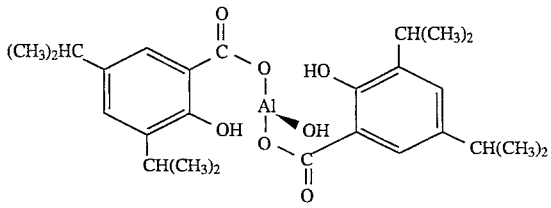
a
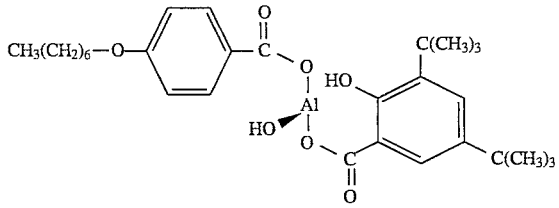
b
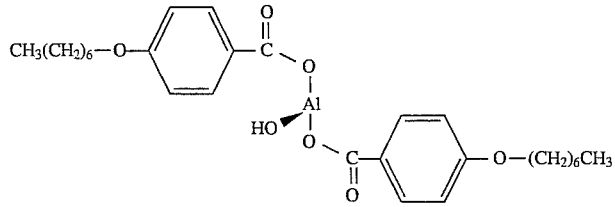
c
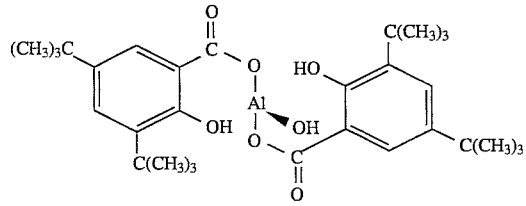

-continued
a 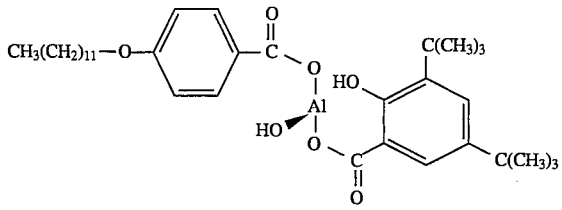
b 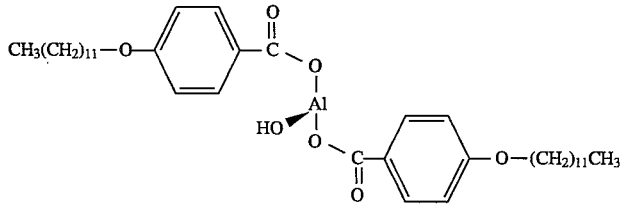
c 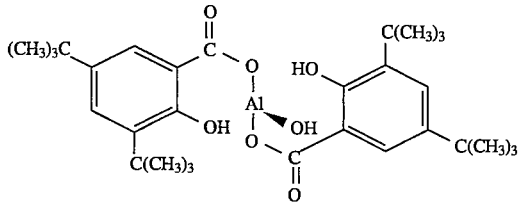
a 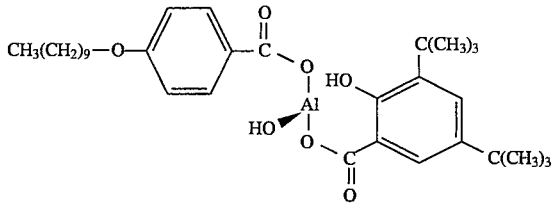
b 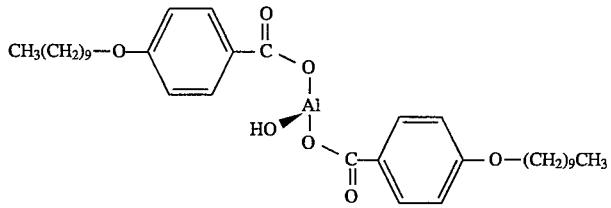
c 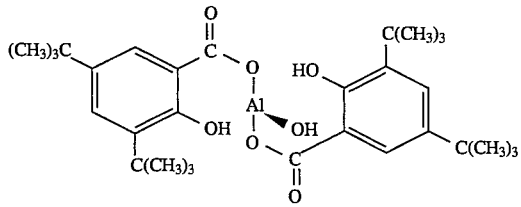

-continued

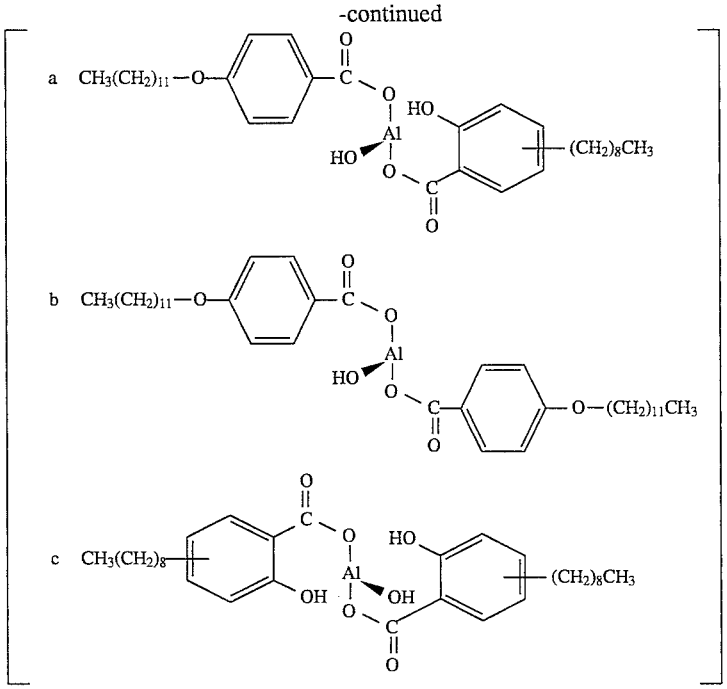

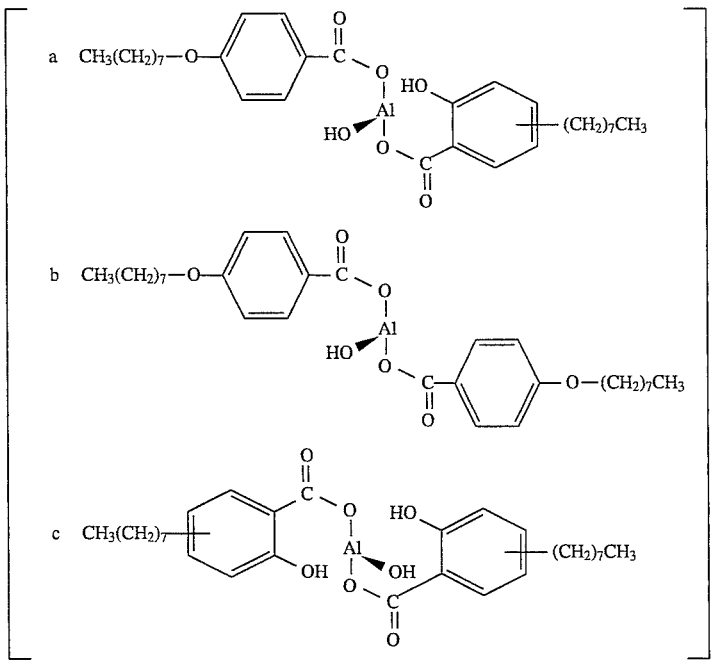

5. A toner in accordance with claim 4 wherein the mixture contains in a ratio of the alkoxy compound to the alkyl compound of from 3:1 to 1:3.

6. A negatively charging toner composition in accordance with claim 1 wherein the charge additive mixture is present in an amount of from about 0.05 to about 20 weight percent of the toner components.

7. A negatively charging toner composition in accordance with claim 4 wherein the charge additive is present in an amount of from about 0.5 to about 5 weight percent of the toner components.

8. A toner in accordance with claim 1 wherein the pigment is carbon black.

9. A toner in accordance with claim 1 wherein the pigment is cyan, magenta, yellow, or mixtures thereof.

10. A toner in accordance with claim 4 wherein the pigment is red, blue, green or brown.

11. A toner in accordance with claim 4 wherein the pigment is carbon black.

12. A toner in accordance with claim 1 wherein the resin is a styrene acrylate, a styrene methacrylate, a polyester, or a styrene butadiene.

13. A toner in accordance with claim 4 wherein the resin is a styrene acrylate, a styrene methacrylate, a polyester, or a styrene butadiene.

14. A toner in accordance with claim 13 wherein the polyester is obtained by reactive extrusion.

15. A toner in accordance with claim 1 wherein the resin is present in an amount of from about 75 to about 95 weight percent.

16. A toner in accordance with claim 4 wherein the resin is present in an amount of from about 75 to about 95 weight percent.

17. A toner in accordance with claim 1 wherein the pigment is present in an amount of from about 5 to about 20 weight percent.

18. A toner in accordance with claim 4 wherein the pigment is present in an amount of from about 5 to about 20 weight percent.

19. A developer comprised of the toner of claim 1 and carrier particles.

20. A developer comprised of the toner of claim 4 and carrier particles.

21. A developer in accordance with claim 20 wherein the carrier particles are comprised of steel, iron, or ferrites.

22. A developer in accordance with claim 20 wherein the carrier contains a coating.

23. An imaging process which comprises the development of a latent image on a photoconductive imaging member with the toner of claim 1.

24. An imaging process which comprises the development of a latent image on a photoconductive imaging member with the toner of claim 4.

25. An imaging process which comprises (1) charging an imaging member in an imaging apparatus; (2) creating on the member a latent image comprising areas of high, intermediate, and low potential; (3) developing the low areas of potential with a first developer of claim 20; (4) developing the high areas of potential with a second developer comprising carrier and a second toner comprised of resin, pigment, and a charge enhancing additive that enables a positively charged toner; (5) transferring the resulting developed image to a substrate; and (6) fixing the image thereto.

26. A toner in accordance with claim 4 further containing surface additives selected from the group consisting of metal salts, metal salts of fatty acids, colloidal silicas, and mixtures thereof.

27. A toner in accordance with claim 26 wherein the surface additive is zinc stearate.

28. A toner in accordance with claim 26 wherein the surface additive is a fumed silica.

29. A toner in accordance with claim 1 wherein the charge additive mixture is {[hydroxy bis(3,5-di-tertiary-butyl salicylic) aluminate], [hydroxy bis(4-nonyloxybenzoic) aluminate], [hydroxy (3,5-di-tertiary-butyl salicylic, 4-nonyloxybenzoic) aluminate]}; {[hydroxy bis(3,5-di-isopropyl salicylic) aluminate], [hydroxy bis(4-nonyloxybenzoic) aluminate], [hydroxy (3,5-di-tertiary-butyl salicylic, 4-nonyloxybenzoic) aluminate]}; {[hydroxy bis(3,5-di-tertiary-butyl salicylic) aluminate], [hydroxy bis(4-heptyloxybenzoic) aluminatel, [hydroxy (3,5-di-tertiary-butyl salicylic, 4-heptyloxybenzoic) aluminate]}; {[hydroxy bis(3,5-di-tertiary-butyl salicylic) aluminate], [hydroxy bis(4-dodecyloxybenzoic) aluminate], [hydroxy (3,5-di-tertiary-butyl salicylic, 4-dodecyloxybenzoic) aluminatel}; {[hydroxy bis(3,5-di-tertiary-butyl salicylic) aluminate], [hydroxy bis(4-decyloxybenzoic) aluminate], [hydroxy (3,5-di-tertiary-butyl salicylic, 4-decyloxybenzoic) aluminate]}; {[hydroxy bis-(nonyl salicylic) aluminate], hydroxy bis(4-dodecyloxybenzoic) aluminate],, [hydroxy (nonyl salicylic, 4-dodecyloxybenzoic) aluminatel}; or {[hydroxy bis(nonyl salicylic) aluminate], [hydroxy bis(4-nonyloxybenzoic) aluminate], [hydroxy (nonyl salicylic, 4-nonyloxybenzoic) aluminate]}.

30. A toner in accordance with claim 1 wherein the mixture contains from about 40 to about 60 weight percent of a), and about 10 to about 20 weight percent of c).

31. A toner in accordance with claim 4 wherein the mixture contains in a ratio of said alkoxy compound to alkyl compound of 1:1.

32. A toner in accordance with claim 1 wherein the mixture is obtained by the reaction of an inorganic aluminum salt with a mixture of an alkyl salicylic acid and an alkoxy benzoic acid.

33. A toner composition consisting of resin, pigment, and a charge enhancing additive mixture salt selected from the group consisting of {[hydroxy bis(3,5-di-tertiary-butyl salicylic) aluminate],, [hydroxy bis(4-nonyloxybenzoic) aluminate], [hydroxy (3.5-di-tertiary-butyl salicylic, 4-nonyloxybenzoic) aluminate],}; {[hydroxy bis(3,5-di-isopropyl salicylic) aluminate], [hydroxy bis(4-nonyioxybenzoic) aluminate],, [hydroxy (3,5-di-tertiary-butyl salicylic. 4-nonyloxybenzoic) aluminate]}; {[hydroxy bis(3,5-di-tertiary-butyl salicylic) aluminate], [hydroxy bis(4-heptyloxybenzoic) aluminate], [hydroxy (3,5-di-tertiary-butyl salicylic, 4-heptyloxybenzoic) aluminate]}; {[hydroxy bis(3,5-di-tertiary-butyl salicylic) aluminate],, [hydroxy bis(4-dodecyloxybenzoic) aluminate],, [hydroxy (3,5-di-tertiary-butyl salicylic, 4-dodecyloxybenzoic) aluminate]}; {[hydroxy bis(3,5-di-tertiary-butyl salicylic) aluminate], [hydroxy bis(4-decyloxybenzoic) aluminate], [hydroxy (3,5-di-tertiary-butyl salicylic, 4-decyloxybenzoic) aluminate]}; {[hydroxy bis-(nonyl salicylic) aluminate], [hydroxy bis(4-dodecyloxybenzoic) aluminate], [hydroxy (nonyl salicylic, 4-dodecyloxybenzoic) aluminate],}; or {[hydroxy bis(nonyl salicylic) aluminate], [hydroxy bis(4-nonyloxybenzoic) aluminate], [hydroxy (nonyl salicylic, 4-nonyloxybenzoic) aluminate],}.

* * * * *